US009251742B2

(12) United States Patent
Kuo et al.

(10) Patent No.: US 9,251,742 B2
(45) Date of Patent: Feb. 2, 2016

(54) ELECTROPHORETIC DISPLAY APPARATUS AND IMAGE-UPDATING METHOD THEREOF

(75) Inventors: Ping-Sheng Kuo, Hsin-Chu (TW); Hsiang-Lin Lin, Hsin-Chu (TW); Chih-Cheng Chan, Hsin-Chu (TW); Sheng-Wen Huang, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 337 days.

(21) Appl. No.: 13/439,976

(22) Filed: Apr. 5, 2012

(65) Prior Publication Data

US 2012/0268442 A1 Oct. 25, 2012

(30) Foreign Application Priority Data

Apr. 21, 2011 (TW) ..... 100113929 A

(51) Int. Cl.
*G09G 3/34* (2006.01)

(52) U.S. Cl.
CPC ..... *G09G 3/344* (2013.01); *G09G 2310/0275* (2013.01); *G09G 2310/0281* (2013.01)

(58) Field of Classification Search
CPC ..... G09G 3/344; G02F 1/167; H03K 3/037
USPC ..... 345/107–109, 208, 211–213, 536; 327/219
See application file for complete search history.

(56) References Cited

U.S. PATENT DOCUMENTS

| | | | | |
|---|---|---|---|---|
| 3,912,948 | A | 10/1975 | Bapat | |
| 2002/0005832 | A1* | 1/2002 | Katase | 345/107 |
| 2004/0257136 | A1* | 12/2004 | Osame et al. | 327/219 |
| 2008/0143668 | A1* | 6/2008 | Shin et al. | 345/107 |
| 2008/0143700 | A1* | 6/2008 | Shin et al. | 345/208 |
| 2010/0134504 | A1* | 6/2010 | Nam et al. | 345/536 |
| 2011/0096053 | A1* | 4/2011 | Yamazaki | 345/211 |

* cited by examiner

*Primary Examiner* — Jonathan Boyd
*Assistant Examiner* — James Nokham
(74) *Attorney, Agent, or Firm* — WPAT, PC; Justin King

(57) ABSTRACT

An electrophoretic display apparatus and an image-updating method thereof are provided. The electrophoretic display apparatus comprises a display panel and a source driver. The display panel comprises a plurality of pixels and a plurality of source lines, and each pixel electrode is electrically coupled to an AC common voltage through a corresponding capacitor. The capacitor comprises a plurality of charged particles. The source driver comprises a first data-latching circuit and a second data-latching circuit. Each of the data-latching circuits comprises a transistor, a capacitor and an inverter. The first data-latching circuit receives image data and a data shift-register output pulse. The second data-latching circuit is electrically coupled between an output terminal of the first data-latching circuit and a source line and is used for receiving a data output pulse.

18 Claims, 8 Drawing Sheets

ELECTROPHORETIC DISPLAY APPARATUS AND IMAGE-UPDATING METHOD THEREOF

TECHNICAL FIELD

The present invention relates to an electrophoretic display apparatus and an image-updating method thereof, and more particularly to an electrophoretic display apparatus with a slim border design and an image-updating method thereof.

BACKGROUND

The inner circuit structure of the current source driver adopted in an electrophoretic display apparatus generally comprises a plurality of control circuits corresponding to the number of the source lines. For the common electrode above the electrophoretic film and biased by a DC voltage (i.e., DC-common), the pixel potential should have three levels, that is, high level, low level, and common level. The three levels are respectively used to move particles upward, to move particles downward and to hold particles at the same position. Therefore, two-bit data is needed. Because each of the control circuits must receive the image data with the two bits, each of the control circuits must use two same circuits to process the image data with the two bits, and each of the control circuits further comprises an additional decoding circuit to decode the image data with the two bits. Therefore, in the condition of having a plurality of pins, the circuit of the conventional source driver is very complex, and the size of the circuit of the source driver is very large. Furthermore, the width of the outer frame of the display panel is determined by the size of the source driver (which is more complex than the gate driver), thus it is difficult to reduce the width of the outer frame of the display panel because the source driver is very complex, and it goes against the trend of narrowing the frame of the display panel.

SUMMARY

The present invention relates to an electrophoretic display apparatus, in which a source driver is simple, the size of the source driver is reduced so that the electrophoretic display apparatus fits with the trend of narrowing a frame thereof.

The present invention also relates to an image-updating method adapted to the electrophoretic display apparatus.

The present invention provides an electrophoretic display apparatus, which comprises a display panel and a source driver. The display panel comprises a plurality of pixels and a plurality of source lines. Each of the pixels is electrically coupled to a corresponding one of the source lines, and each of the pixels comprises a pixel electrode and a capacitor. The capacitor comprises a plurality of charged particles. The pixel electrode of each of the pixels is electrically coupled to an alternating current (AC) common voltage through a corresponding capacitor. The source driver is electrically coupled to the source lines. The source driver comprises a first data-latching circuit and a second data-latching circuit. The first data-latching circuit comprises a first transistor, a first capacitor and a first inverter. The first transistor has a first source/drain terminal, a second source/drain terminal and a gate terminal. The first source/drain terminal of the first transistor is configured for receiving image data, and the gate terminal of the first transistor is configured for receiving a data shift-register output pulse. The first capacitor is electrically coupled between the second source/drain terminal of the first transistor and a reference voltage. The first inverter has an input terminal and an output terminal. The input terminal of the first inverter is electrically coupled to the second source/drain terminal of the first transistor. The second data-latching circuit comprises a second transistor, a second capacitor and a second inverter. The second transistor has a first source/drain terminal, a second source/drain terminal and a gate terminal. The first source/drain terminal of the second transistor is electrically coupled to the output terminal of the first inverter, and the gate terminal of the second transistor is configured for receiving a latching-enable pulse. The second capacitor is electrically coupled between the second source/drain terminal of the second transistor and the reference voltage. The second inverter has an input terminal and an output terminal. The input terminal of the second inverter is electrically coupled to the second source/drain terminal of the second transistor, and the output terminal of the second inverter is electrically coupled to one of the source lines.

The present invention also provides an image-updating method for an electrophoretic display apparatus. The electrophoretic display apparatus comprises a display panel and a source driver. The display panel comprises a plurality of pixels and a plurality of source lines. Each of the pixels is electrically coupled to a corresponding one of the source lines, and each of the pixels comprises a pixel electrode and a capacitor. The capacitor comprises a plurality of charged particles. The source driver is electrically coupled to the source lines, and the source driver comprises a first data-latching circuit and a second data-latching circuit. The first data-latching circuit comprises a first transistor, a first capacitor and a first inverter. The first transistor has a first source/drain terminal, a second source/drain terminal and a gate terminal. The first source/drain terminal of the first transistor is configured for receiving image data, and the gate terminal of the first transistor is configured for receiving a data shift-register output pulse. The first capacitor is electrically coupled between the second source/drain terminal of the first transistor and a reference voltage. The first inverter has an input terminal and an output terminal. The input terminal of the first inverter is electrically coupled to the second source/drain terminal of the first transistor. The second data-latching circuit comprises a second transistor, a second capacitor and a second inverter. The second transistor has a first source/drain terminal, a second source/drain terminal and a gate terminal. The first source/drain terminal of the second transistor is electrically coupled to the output terminal of the first inverter, and the gate terminal of the second transistor is configured for receiving a latching-enable pulse. The second capacitor is electrically coupled between the second source/drain terminal of the second transistor and the reference voltage. The second inverter has an input terminal and an output terminal. The input terminal of the second inverter is electrically coupled to the second source/drain terminal of the second transistor, and the output terminal of the second inverter is electrically coupled to one of the source lines. The image-updating method comprises the following steps: providing an alternating current (AC) common voltage so that the particles in the electrophoretic film being driven by the electrical field caused by the common electrode and the pixel electrode; making the AC common voltage present a first potential, and making a voltage of the output terminal of the second inverter present a second potential, so as to erase a previous image; and making the AC common voltage present the second potential, and making the voltage of the output terminal of the second inverter drive a corresponding one of the pixels in three stages, wherein the voltage of the output terminal of the second inverter presents the first potential in a first stage, the voltage of the output terminal of the second inverter presents the second potential in a second stage, and the voltage of the output terminal of the second inverter presents the first potential in a third stage.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
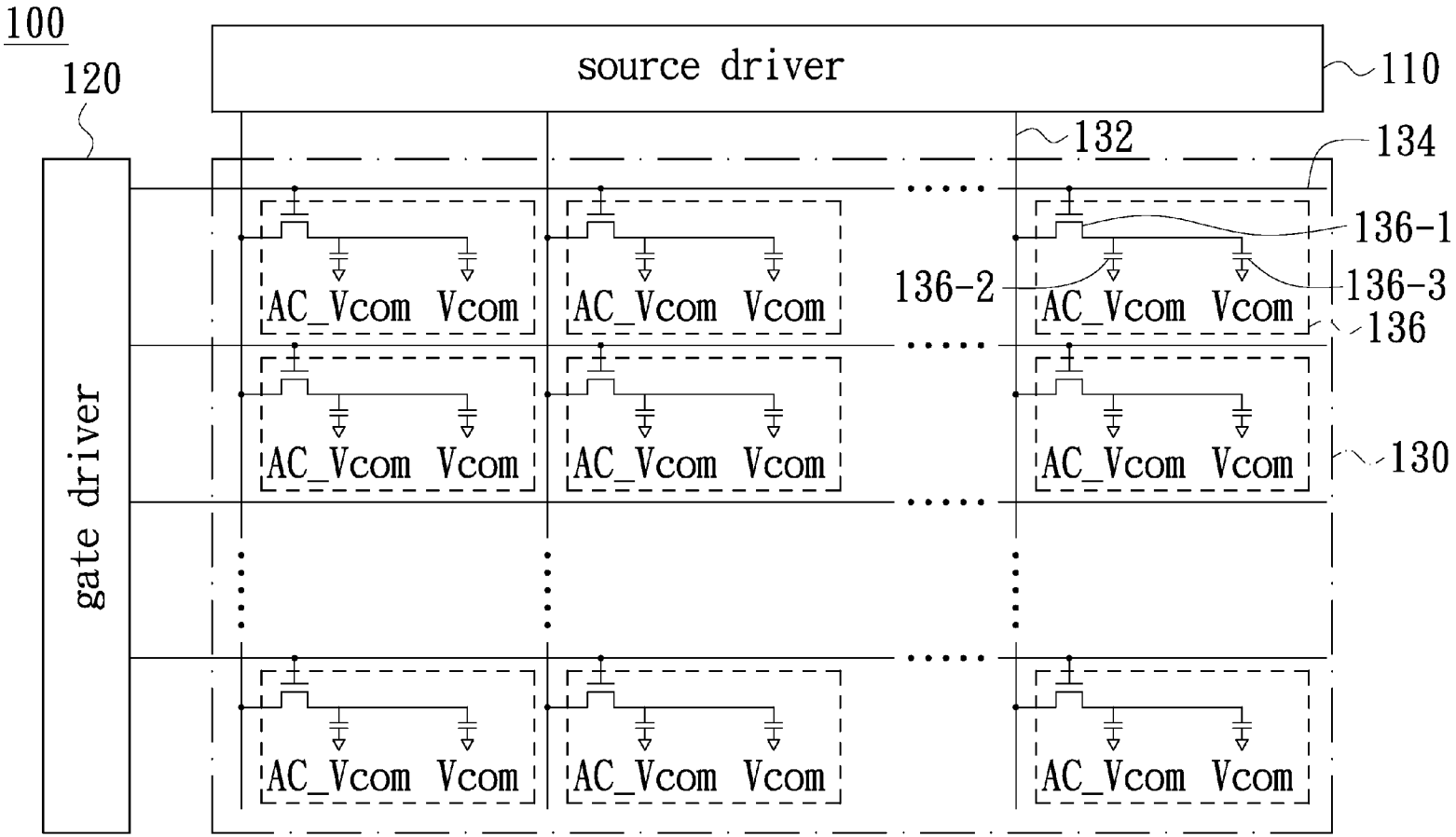
FIG. 1 is a circuit schematic view of an electrophoretic display apparatus in accordance with an exemplary embodiment of the present invention.

FIG. 1 is a circuit schematic view of an electrophoretic display apparatus in accordance with an exemplary embodiment of the present invention. Referring to FIG. 1, the electrophoretic display apparatus 100 mainly comprises a source driver 110, a gate driver 120 and a display panel 130. The display panel 130 comprises a plurality of source lines 132, a plurality of gate lines 134 and a plurality of pixels 136. Each of the pixels 136 is electrically coupled to a corresponding one of the source lines 132 and a corresponding one of the gate lines 134. Each of the pixels 136 comprises a transistor 136-1, a capacitor 136-2 and a storage capacitor 136-3. The capacitor 136-2 comprises electrophoretic fluid (will be described later). A connection between the transistor 136-1 and the capacitor 136-2 is served as a pixel electrode of the pixel 136. Each pixel electrode (not marked) of the electrophoretic display apparatus 100 is electrically coupled to an alternating current (AC) common voltage AC_Vcom through a corresponding capacitor 136-2, and each pixel electrode of the electrophoretic display apparatus 100 is electrically coupled to a common voltage Vcom through a corresponding storage capacitor 136-3. The AC common voltage AC-Vcom is provided by a common electrode of an upper substrate of the display panel 130. In addition, the electrophoretic display apparatus 100 uses a source driver 110 with a simple circuit. The source driver 110 and the gate driver 120 are both disposed in an outer frame (not shown) of the display panel 130.

Figure 2:
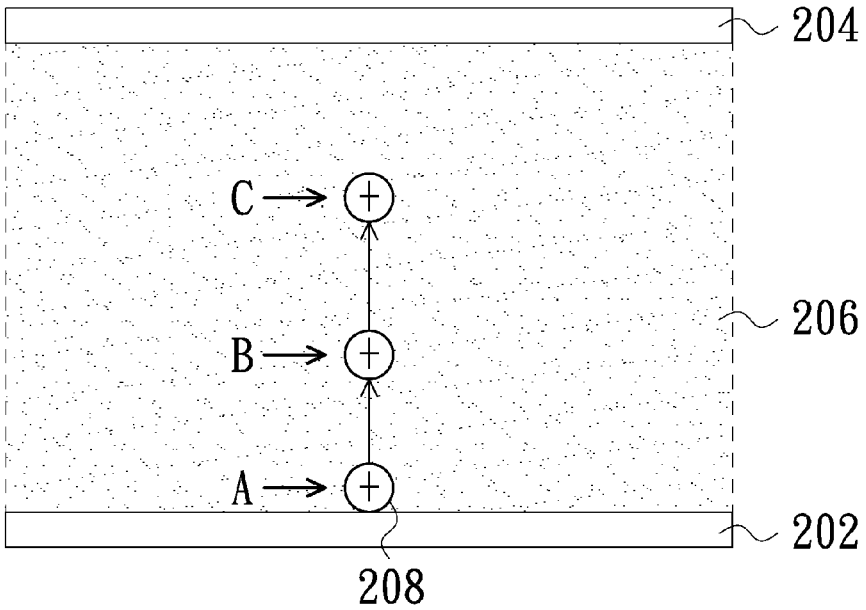
FIG. 2 is a cross-sectional schematic view of one pixel as shown in FIG. 1.
Figure 3:
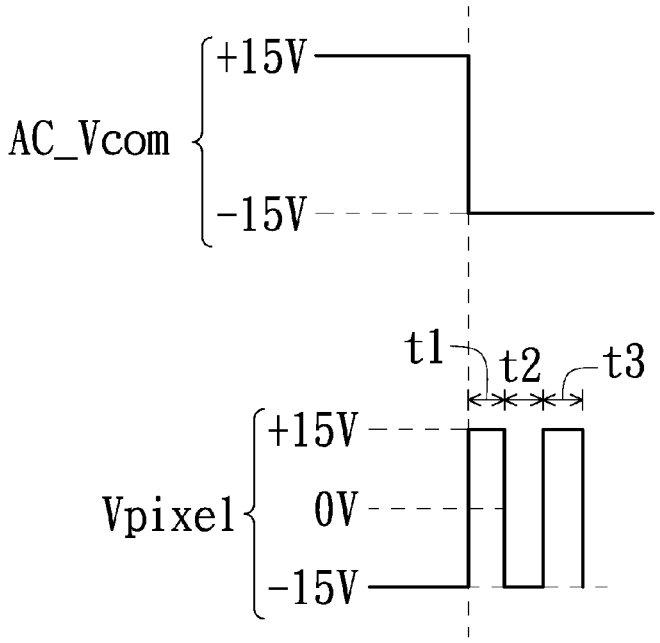
FIG. 3 is a schematic view for showing waves of various driving signals of the pixel according to an exemplary embodiment of the present invention.

FIG. 2 is a schematic view of the pixel 136 of the electrophoretic display apparatus 100, and the following will employ FIGS. 2 and 3 to describe an image-updating method of the pixel 136 of the electrophoretic display apparatus 100. FIG. 3 is a schematic view for showing waves of various driving signals of the pixel according to an exemplary embodiment of the present invention. In FIG. 3, a label AC_Vcom represents the AC common voltage provided by the common electrode 204 as shown in FIG. 2, and the AC common voltage AC_Vcom has two different potentials such as +15V and −15V. A label Vpixel represents the voltage of the pixel electrode 202 as shown in FIG. 2.

Referring to FIGS. 3 and 2, when the pixel 136 as shown in FIG. 2 updates display content, the AC common voltage AC_Vcom is +15V, and the gate driver 120 turns on the transistor 136-1 of the pixel 136 through one of the gate lines 134 corresponding to the pixel 136, and the source driver 110 transmits the potential of −15V to the pixel electrode 202 through one of the source line 132 corresponding to the pixel 136 at the moment. Thus, the charged particle 208 moves to the position A to erase the previous image. After the previous image is erased, the AC common voltage AC_Vcom is altered to −15V, and the gate driver 120 will turn on the transistor 136-1 of the pixel 136 again. The following will illustrate the driving mode of the AC common voltage AC_Vcom. Herein, the source driver 110 drives the pixel 136 in three stages. Firstly, in a first stage t1, the source driver 110 may transmit the potential of +15V to the pixel electrode 202 through one of the source lines 132 corresponding to the pixel 136, so that the charged particle 208 moves from the position A to the position B. Then, in a second stage t2, the source driver 100 may transmit the potential of −15V to the pixel electrode 202 through one of the source lines 132 corresponding to the pixel 136, so that the charged particle 208 keeps staying at the position B. Finally, in a third stage t3, the source driver 110 may transmit the potential of +15V to the pixel electrode 202 through one of the source line 132 corresponding to the pixel 136, so that the charged particle 208 moves from the position B to the target position, that is, the position C.

From the above description, it can be seen that each of output terminals of the source driver 110 only needs to output two different potentials to perform the driving mode of the conventional source driver in three stages. With AC common driving, at the end of shaking phase (i.e., the first potential of the AC common voltage), particles may stay at the bottom of electrophoretic films. In the following phase-writing phase, the AC common voltage presents a second potential. Therefore, the pixel electrode only needs to provide two potentials, that is, high potential and low potential, and thus the source driver only requires one-bit data input. The following will describe some exemplary embodiments of the source driver in detail.

First Embodiment

Figure 4:
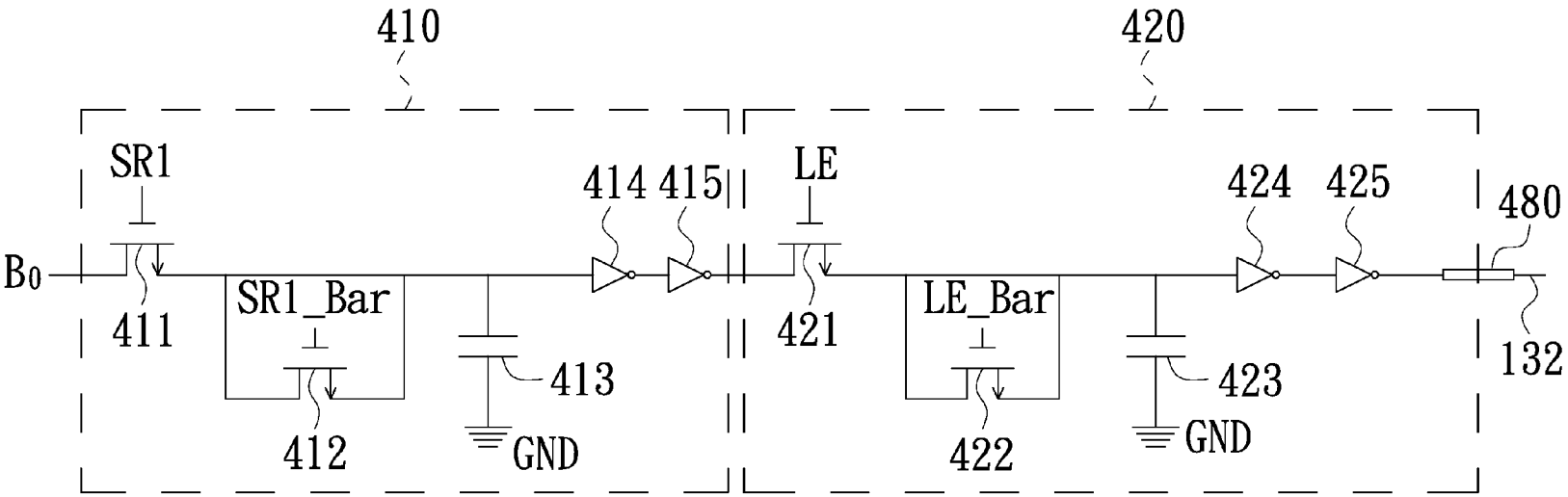
FIG. 4 is a circuit schematic view of a control circuit corresponding to an output terminal of a source driver.

FIG. 4 is a circuit schematic view of a control circuit corresponding to an output terminal of the source driver 110. Referring to FIG. 4, the control circuit comprises a first data-latching circuit 410 and a second data-latching circuit 420. The first data-latching circuit 410 comprises a transistor 411, a transistor 412, a capacitor 413, an inverter 414 and an inverter 415. A source/drain terminal of the transistor 411 is configured for receiving image data with one bit (as marked by a label B0). A gate terminal of the transistor 411 is configured for receiving a data shift-register output pulse SR1, and the data shift-register output pulse SR1 is outputted by a shift register (not shown). Two source/drain terminals of the transistor 412 are both electrically coupled to the other source/drain terminal of the transistor 411, and a gate terminal of the transistor 412 is configured for receiving an inverted signal SR1_Bar. The data shift-register output pulse SR1 and the inverted signal SR1_Bar have opposite phases. The capacitor 413 is electrically coupled between the other source/drain terminal of the transistor 411 and a reference voltage such as the ground voltage GND. An input terminal of the inverter 414 is electrically coupled to the other source/drain terminal of the transistor 411. An input terminal of the inverter 415 is electrically coupled to an output terminal of the inverter 414, and an output terminal of the inverter 415 is served as an output terminal of the first data-latching circuit 410.

The second data-latching circuit 420 comprises a transistor 421, a transistor 422, a capacitor 423, an inverter 424 and an inverter 425. A source/drain terminal of the transistor 421 is electrically coupled to the output terminal of the inverter 415, and a gate terminal of the transistor 421 is configured for receiving a latching-enable pulse LE. Two source/drain terminals of the transistor 422 are both electrically coupled to the other source/drain terminal of the transistor 421, and a gate terminal of the transistor 422 is configured for receiving an inverted signal LE_Bar. The latching-enable pulse LE and the inverted signal LE_Bar have opposite phases. The capacitor 423 is electrically coupled between the other source/drain terminal of the transistor 421 and the ground voltage GND. An input terminal of the inverter 424 is electrically coupled to the other source/drain terminal of the transistor 421. An input terminal of the inverter 425 is electrically coupled to an output terminal of the inverter 424, and an output terminal of the inverter 425 is electrically coupled to a source line 132 through an output terminal 480 of the control circuit (which is served as an output terminal of the source driver 110). In addition, all of the transistors as shown in FIG. 4 are, for example, N-type transistors or oxide thin film transistors.

It should be noted that both of the transistors 412 and 422 of FIG. 4 are only configured for solving the feed-through effect, thus the present invention may omit both of the transistors 412 and 422 or only omit any one of the transistors 412 and 422. Furthermore, the use of the transistors 412 and 422 for solving the feed-through effect is understood for persons skilled in the art, and it will not be further described herein. In addition, it is understood for persons skilled in the art that each of the data-latching circuits as shown in FIG. 4 may only use a single inverter to perform the present invention.

Figure 5:
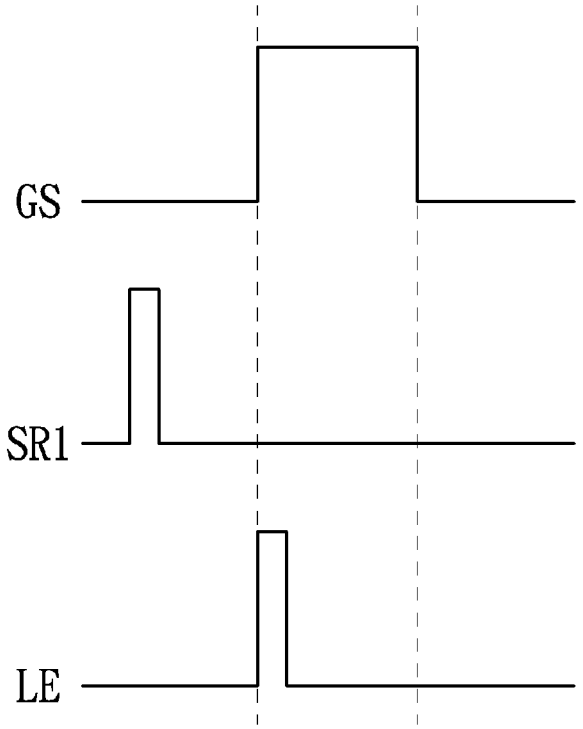
FIG. 5 is a schematic view for showing time-sequence relation between a gate pulse, a data shift-register output pulse, and a latching-enable pulse.

FIG. 5 is a schematic view for showing time-sequence relation between a gate pulse, a data shift-register output pulse, and a latching-enable pulse. In FIG. 5, a label GS represents a gate pulse outputted from the gate driver 120, a label SR1 represents the data shift-register output pulse, and a label LE represents the latching-enable pulse. As shown in FIG. 5, the enabling period of the latching-enable pulse LE is substantially within the enabling period of the gate pulse GS, and the enabling period of the data shift-register output signal SR is preceding the enabling period of the latching-enable pulse LE.

Referring to FIGS. 5 and 4, when the data shift-register output pulse SR1 is in the high potential, the transistor 411 is turned on so that the first data-latching circuit 410 performs a data-latching operation on the image data $B_0$. When the latching-enable pulse LE is in the high potential, the transistor 421 is turned on so that the second data-latching circuit 420 may output the image data $B_0$ latched by the first data-latching circuit 410. Referring to FIG. 5, it can be seen that before the gate pulse GS changes from the low potential to the high potential, the first data-latching circuit 410 of each control circuit of the source driver 410 must latch corresponding image data. When the gate pulse GS is in the high potential, the second data-latching circuit 420 of each control circuit must output the image data latched by the first data-latching circuit 410 to the corresponding source lines 132 according to the latching-enable pulse LE.

Second Exemplary Embodiment

The second exemplary embodiment may also be illustrated by FIG. 4. Referring to FIG. 4 again, the second exemplary embodiment is similar to the first exemplary embodiment except that each of the inverters of the second exemplary embodiment may be a boost inverter.

Figure 6:
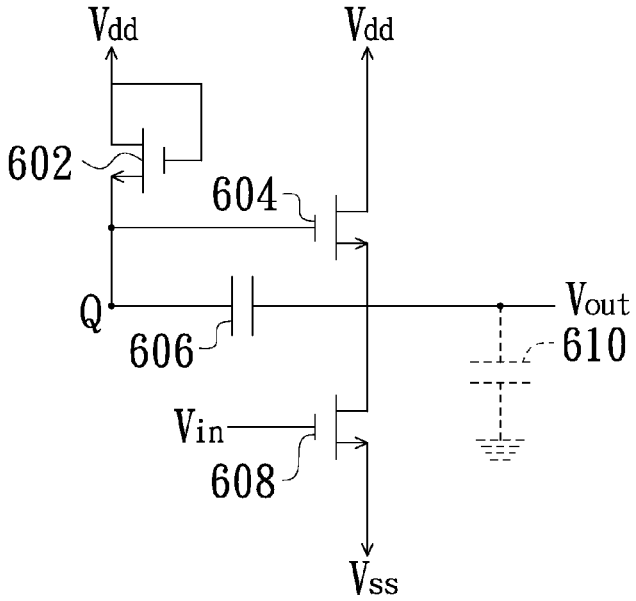
FIG. 6 is a circuit schematic view of a boost inverter.

FIG. 6 is a circuit schematic view of a boost inverter. In FIG. 6, labels 602, 604 and 608 represent transistors, a label 606 represents a capacitor, a label 610 represents an equivalent capacitor of a back-end circuit, a label $V_{dd}$ represents a power voltage, a label $V_{SS}$ represents a reference voltage, a label $V_{in}$ represents an input voltage, and a label $V_{out}$ represent an output voltage. The transistors are all N-type transistors, and the size of the transistor 608 (that is, a pull-down transistor) is generally larger than that of the transistor 604 (that is, a pull-up transistor). In addition, the power voltage $V_{dd}$ may be +15V, and the reference voltage VSS may be −15V.

When the input voltage $V_{in}$ is in the high potential, the transistor 608 is turned on. At the moment, the effect of the transistor 608 for pulling down the output voltage $V_{out}$ is larger than the effect of the transistor 604 for pulling up the output voltage $V_{out}$. Thus, the output voltage $V_{out}$ is close to the reference voltage $V_{SS}$, and the voltage of the node Q is $V_{dd}-V_{th}$. When the input voltage $V_{in}$ transits to the low potential, the transistor 608 is turned off. At the moment, the transistor 604 pulls up the output voltage $V_{out}$ to the potential of the power voltage $V_{dd}$. Since the voltage across the capacitor cannot be altered instantaneously, the voltage of the node Q is pulled up over the potential of the power potential $V_{dd}$, so that the transistor 602 is turned off. The transistor 602 is turned off so that the voltage of the node Q may keep in a period. Thus, even if the output voltage $V_{out}$ is the value of reducing the voltage of the node Q by the threshold voltage of the transistor 604, the output voltage $V_{out}$ is prone to reach the potential of the power voltage $V_{dd}$.

From the above description, it can be seen that when the transistor 608 is turned off from turned on, the voltage of the node Q is pulled up over the potential of the power voltage $V_{dd}$, so that the driving capability of the transistor 604 is greatly improved, and the output voltage of the whole inverter reaches the potential of the power voltage Vdd (that is, the output voltage thereof may reach positive saturation). Thus, the boost inverter has an enough capability to drive a next-stage circuit without employing the transistor with the large size, and the preceding-stage circuit of the boost inverter may obtain a small size. Therefore, the present invention may employ the boost inverter to further reduce the size of the source driver 110, and the driving capability of the source driver 110 employing the boost inverter is more powerful than that of the conventional source driver.

It should be noted that although all of the inverters are boost inverters in the exemplary embodiment, the present invention is not limited herein. For example, in other design, only the last inverter (the inverter 425) of the second data-latching circuit 420 employs a boost inverter, and other inverters are inverters of any type.

Third Exemplary Embodiment

There is a disadvantage for the source driver 110 of the second exemplary embodiment, that is, the boost inverter thereof may not perform the pull-up operation for a long time, which will be described by FIG. 7.

Figure 7:
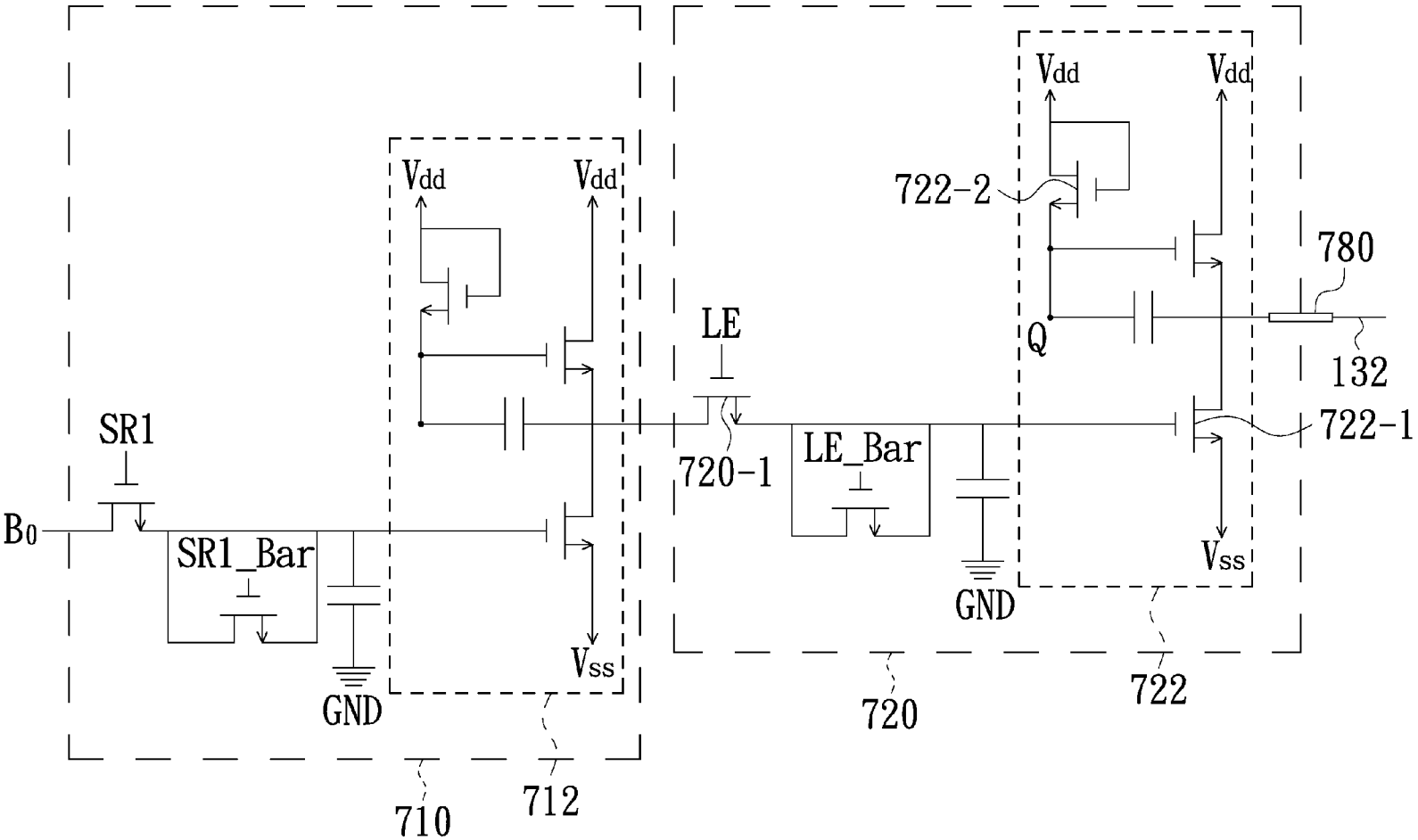
FIG. 7 is a schematic view of a control circuit of a source driver corresponding to an output terminal thereof in accordance with an exemplary embodiment of the present invention.

FIG. 7 is a schematic view of a control circuit of the source driver 110 corresponding to an output terminal thereof in accordance with an exemplary embodiment of the present invention. As shown in FIG. 7, the control circuit comprises a first data-latching circuit 710 and a second data-latching circuit 720. Each of the data-latching circuit 710 and the data-latching circuit 720 comprises a boost inverter, and the two boost inverters are marked by labels 712 and 722, respectively. In addition, a label $B_0$ represents image data with one bit, a label SR1 represents a data shift-register output pulse, a label SR1_Bar represents an inverted signal of the data shift-register output pulse SR1, a label GND represents a reference voltage, that is the ground voltage, a label $V_{dd}$ represents a power voltage, a label $V_{SS}$ represents a reference voltage, a label LE represents latching-enable pulse, a label LE_Bar represents an inverted signal of the latching-enable pulse, a label 780 represents an output terminal of the control circuit (that is, an output terminal of the source driver 110), and a label 132 represents a source line. The power voltage $V_{dd}$ may be +15V, and the reference voltage $V_{SS}$ may be −15V. In addition, a pull-down transistor of each of the boost inverters has a larger size than a pull-up transistor thereof.

If the current value of the image data $B_0$ is 0 (that is, the low potential), a voltage outputted from the first data-latching circuit 710 is pulled up to the power voltage $V_{dd}$. Thus, when the transistor 720-1 is turned on, the gate terminal of the transistor 722-1 will receive a voltage equal to the power voltage Vdd, so that the transistor 722-1 is completely turned on, and a voltage outputted from the second data-latching circuit 720 is pulled down to a voltage close to the reference voltage $V_{SS}$. Then, if the current value of the image data $B_0$ is changed from 0 to 1 (that is, the high potential), the voltage outputted from the first data-latching circuit 710 is pulled down to a voltage close to the reference voltage $V_{SS}$. Thus, when the transistor 720-1 is turned on, the gate terminal of the transistor 722-1 will receive a voltage close to the reference voltage $V_{SS}$, so that the transistor 722-1 is half turned off (that is, half turned on) from completely turned on, and the voltage of the node Q is pulled up over the power voltage $V_{dd}$. Therefore, the voltage outputted from the second data-latching circuit 720 reaches the potential of the power voltage $V_{dd}$.

Figure 8:
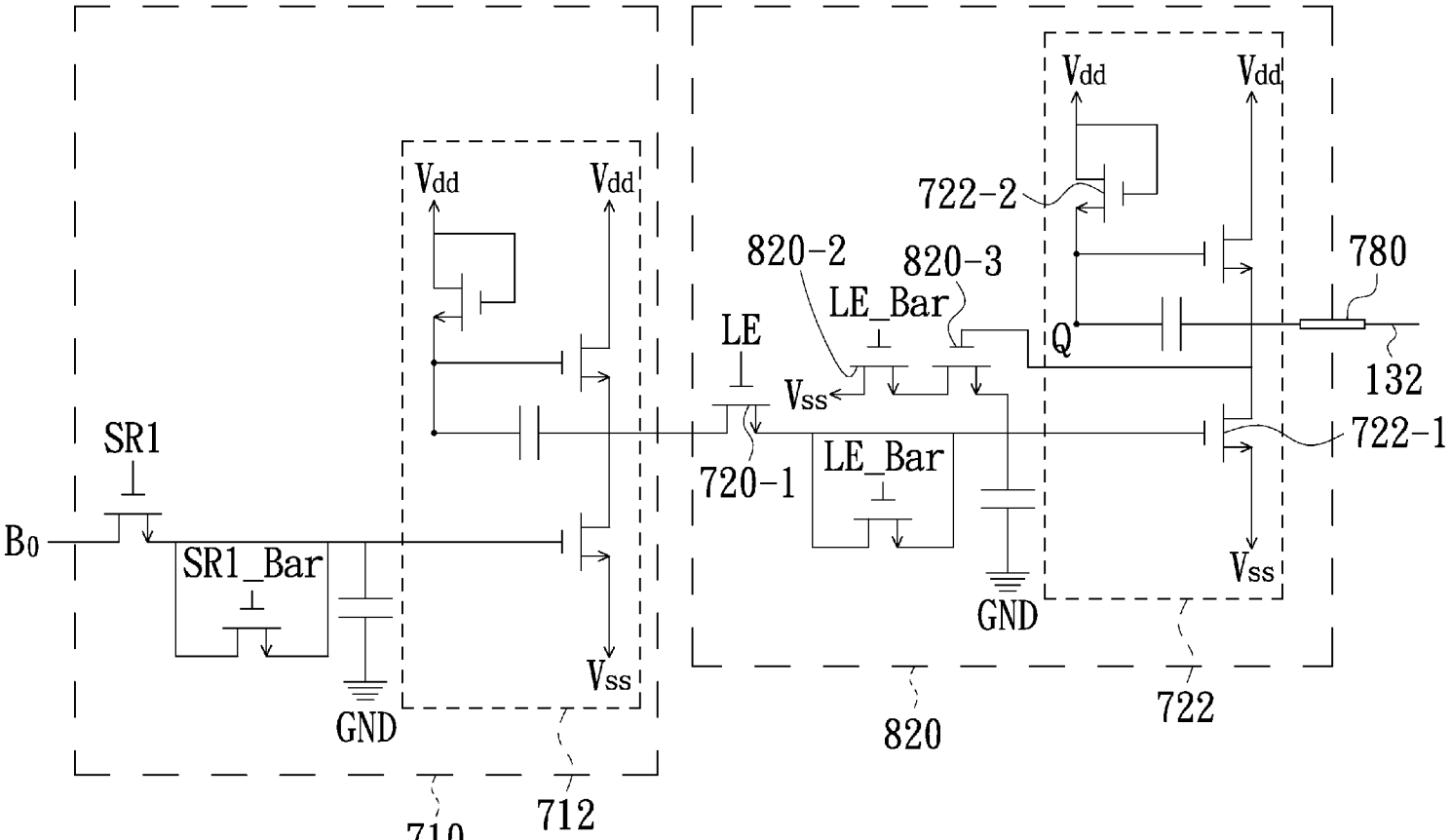
FIG. 8 is a schematic view of a control circuit of a source driver corresponding to an output terminal thereof in accordance with still another exemplary embodiment of the present invention.

FIG. 8 is a schematic view of a control circuit of the source driver 110 corresponding to an output terminal thereof in accordance with still another exemplary embodiment of the present invention. The control circuit as shown in FIG. 8 is similar to that in FIG. 7 except that the second data-latching circuit 820 of the control circuit further comprises transistors 820-2 and 820-3. A source/drain terminal of the transistor 820-2 is electrically coupled to the reference voltage $V_{SS}$. A gate terminal of the transistor 820-2 is configured for receiving the inverted signal LE_Bar of the latching-enable pulse LE. A source/drain terminal of the transistor 820-3 is electrically coupled to the gate terminal of the transistor 722-1, and the other source/drain terminal of the transistor 820-3 is electrically coupled to the other source/drain terminal of the transistor 820-2, and a gate terminal of the transistor 820-3 is electrically coupled to the output terminal 780 of the control circuit. The transistor 820-3 is configured for avoiding logic error.

Figure 9A:
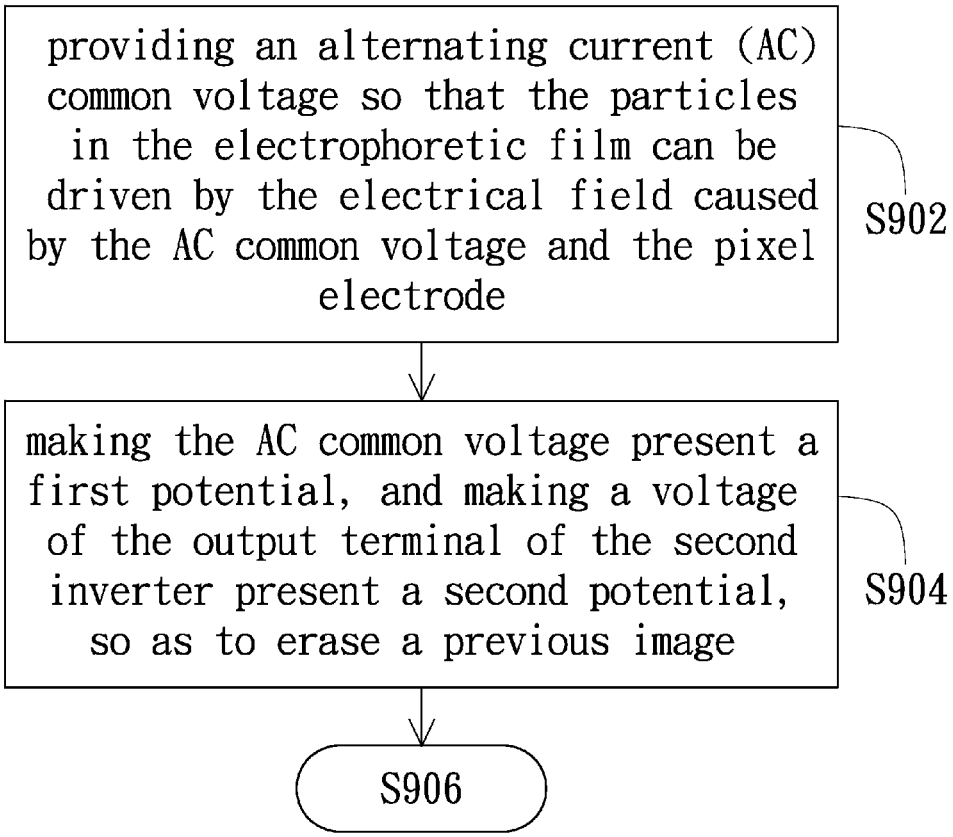
FIGS. 9A and 9B show a flow chart of an image-updating method of an electrophoretic display apparatus in accordance with an exemplary embodiment of the present invention.
Figure 9B:
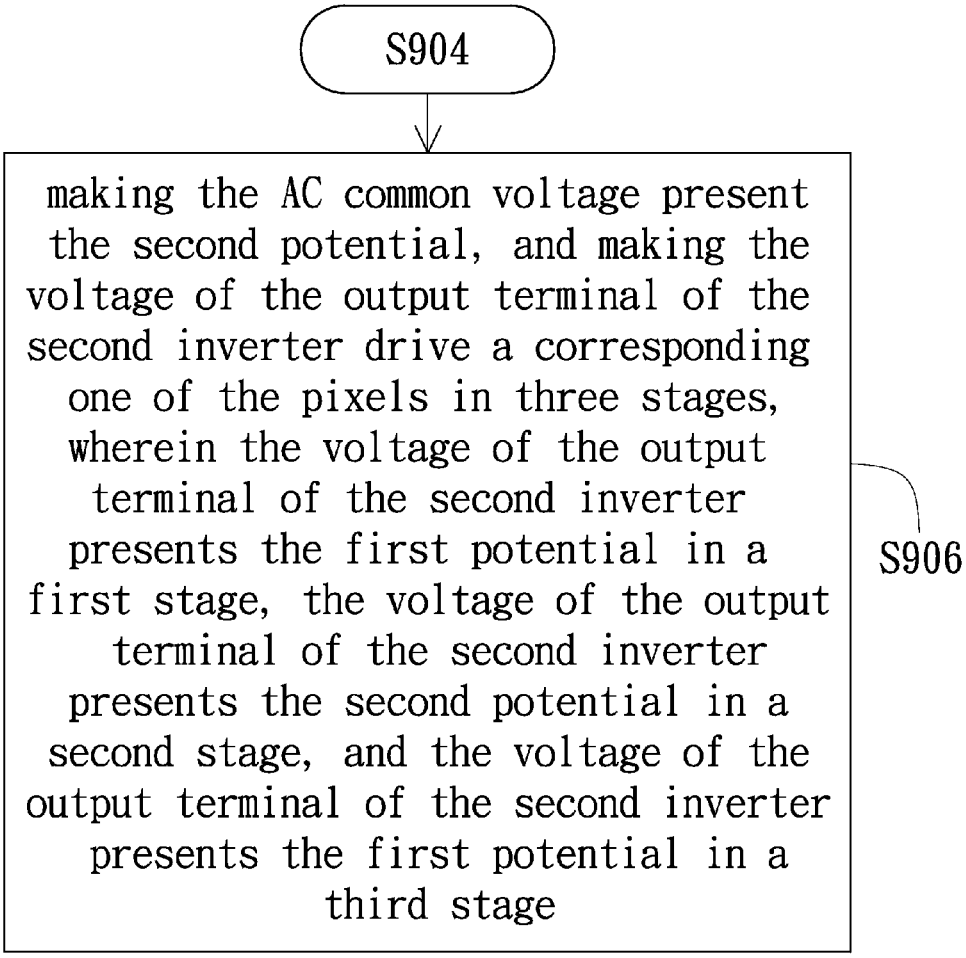

From the above description of the exemplary embodiments, it can conclude an image-updating method of an electrophoretic display apparatus of the present invention. FIGS. 9A and 9B show a flow chart of an image-updating method of an electrophoretic display apparatus in accordance with an exemplary embodiment of the present invention. Referring to FIGS. 9A and 9B, the electrophoretic display apparatus comprises a display panel and a source driver. The display panel comprises a plurality of pixels and a plurality of source lines. Each of the pixels is electrically coupled to a corresponding one of the source lines, and each of the pixels comprises a pixel electrode and a capacitor. The capacitor comprises a plurality of charged particles. The charged particles are with multiple colors. For example, the charged particles comprise black particles and white particles. The source driver is electrically coupled to the source lines. The source driver comprises a first data-latching circuit and a second data-latching circuit. The first data-latching circuit comprises a first transistor, a first capacitor and a first inverter. A source/drain terminal of the first transistor is configured for receiving image data, a gate terminal thereof is configured for receiving a data shift-register output pulse. The first capacitor is electrically coupled between the other source/drain terminal of the first transistor and the ground voltage. An input terminal of the first inverter is electrically coupled to the other source/drain terminal of the first transistor. The second data-latching circuit comprises a second transistor, a second capacitor and a second inverter. A source/drain terminal of the second transistor is electrically coupled to an output terminal of the first inverter, and a gate terminal thereof is configured for receiving a latching-enable pulse. The second capacitor is electrically coupled between the other source/drain terminal of the second transistor and the ground voltage. An input terminal of the second inverter is electrically coupled to the other source/drain terminal of the second transistor, and an output terminal thereof is electrically coupled to a corresponding one of the source lines.

The image-updating method thereof comprises the following steps: providing an alternating current (AC) common voltage so that the particles in the electrophoretic film can be driven by the electrical field caused by the AC common voltage and the pixel electrode (as shown in Step S902); making the AC common voltage present a first potential, and making a voltage of the output terminal of the second inverter present a second potential, so as to erase a previous image (as shown in Step S904); and making the AC common voltage present a second potential, and making the voltage of the output terminal of the second inverter drive the corresponding pixel in three stage. Wherein in a first stage, the voltage of the output terminal of the second inverter presents the first potential. In a second stage, the voltage of the output terminal of the second inverter presents the second potential. In a third stage, the voltage of the output terminal of the second inverter presents the first potential (as shown in Step S906).

In summary, for solving the above problem, the display panel of the present invention employs an AC common voltage with two potentials, thus each of the output terminals of the source driver of the present invention can output the two potentials to perform the driving mode of the conventional source driver for driving the pixels in the three stages. Since each of the output terminals of the source driver only needs to output the two potentials, each control circuit corresponding to an output terminal only needs to receive the image data with the one bit for controlling the output voltage thereof.

Since each control circuit only needs to receive the data image with one bit for controlling the output voltage thereof, the first data-latching circuit and the second data-latching circuit of each control circuit only needs one circuit instead of two same circuits. Furthermore, each control circuit does not need to employ any decoding circuit to perform the decoding operation. Therefore, the source driver is simple, and the size of the source driver may be greatly reduced, thus the electrophoretic display apparatus of the present invention can fit with the trend of narrowing the frame thereof.

In addition, the common inverter of the source driver may be replaced by a boost inverter, thus the size of the source driver may be further reduced. Since the voltage of the gate terminal of the boost inverter may be pulled up over the power voltage $V_{dd}$, to enhance the driving current thereof, the boost inverter does not need to employ the transistor with the large size and has enough capability to drive the next-stage circuit. Furthermore, the size of the preceding-stage circuit is also reduced. According to an embodiment of the invention, when AC common driving is adopted, the size of the source driver can be reduced. In addition, adopting boost inverter can reduce the total circuit area of the source driver to a more practical level. Therefore, the slim boarder design can be achieved. Certainly, a gate driver can also be integrated into the display panel. Thus, the cost of the electrophoretic display will be reduced, and it facilitates the future demonstration in flexible displays.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrophoretic display apparatus, comprising:

a display panel comprising a plurality of pixels and a plurality of source lines, each of the pixels being electrically coupled a corresponding one of the source lines, each of the pixels comprising a pixel electrode and a capacitor, the capacitor comprising a plurality of charged particles, the pixel electrode of each of the pixels being electrically coupled to an alternating current (AC) common voltage through a corresponding capacitor; and a source driver electrically coupled to the source lines, and the source driver comprising:

a first data-latching circuit, comprising:

a first transistor having a first source/drain terminal, a second source/drain terminal and a gate terminal, the first source/drain terminal of the first transistor being configured for receiving image data, and the gate terminal of the first transistor being configured for receiving a data shift-register output pulse;

a first capacitor electrically coupled between the second source/drain terminal of the first transistor and a reference voltage; and a first inverter having an input terminal and an output terminal, the input terminal of the first inverter being electrically coupled to the second source/drain terminal of the first transistor; and a second data-latching circuit, comprising:

a second transistor having a first source/drain terminal, a second source/drain terminal and a gate terminal, the first source/drain terminal of the second transistor being electrically coupled to the output terminal of the first inverter, and the gate terminal of the second transistor being configured for receiving a latching-enable pulse;

a second capacitor electrically coupled between the second source/drain terminal of the second transistor and the reference voltage; and a second inverter having an input terminal and an output terminal, the input terminal of the second inverter being electrically coupled to the second source/drain terminal of the second transistor, and the output terminal of the second inverter being electrically coupled to one of the source lines;

wherein the display panel further comprises a plurality of gate lines, and each of the pixels is electrically coupled to a corresponding one of the gate lines, the electrophoretic display apparatus further comprises a gate driver electrically coupled to the gate lines for respectively outputting a plurality of gate pulses to the gate lines in sequence, the enabling period of the latching-enable pulse is during the enabling period of a corresponding one of the gate pulses outputted from the gate driver, and the enabling period of the data shift-register output pulse is preceding the enabling period of the corresponding one of the gate pulses outputted from the gate driver.

2. The electrophoretic display apparatus according to claim 1, wherein the AC common voltage has a first potential and a second potential, and the voltage outputted by the output terminal of the second inverter presents one of the first potential and the second potential.

3. The electrophoretic display apparatus according to claim 2, wherein the second data-latching circuit further comprises a third transistor having a first source/drain terminal, a second source/drain terminal and a gate terminal, the first source/drain terminal of the third transistor is electrically coupled to the second potential, the gate terminal of the third transistor is configured for receiving an inverted signal of the latching-enable pulse, and the second source/drain terminal of the third transistor is electrically coupled to the second source/drain terminal of the second transistor.

4. The electrophoretic display apparatus according to claim 3, wherein the second data-latching circuit further comprises a fourth transistor having a first source/drain terminal, a second source/drain terminal and a gate terminal, the first source/drain terminal of the fourth transistor is electrically coupled to the second source/drain terminal of the third transistor, the gate terminal of the fourth transistor is electrically coupled to the output terminal of the second inverter, and the second source/drain terminal of the fourth transistor is electrically coupled to the second source/drain terminal of the second transistor.

5. The electrophoretic display apparatus according to claim 2, wherein the first inverter comprises:

a third transistor having a first source/drain terminal, a second source/drain terminal and a gate terminal, the gate terminal and the first source/drain terminal of the third transistor being electrically coupled to the first potential;

a fourth transistor having a first source/drain terminal, a second source/drain terminal and a gate terminal, the first source/drain terminal of the fourth transistor being electrically coupled to the first potential, and the gate terminal of the fourth transistor being electrically coupled to the second source/drain terminal of the third transistor;

a third capacitor electrically coupled between the gate terminal of the fourth transistor and the second source/drain terminal of the fourth transistor; and a fifth transistor having a first source/drain terminal, a second source/drain terminal and a gate terminal, the first source/drain terminal of the fifth transistor being electrically coupled to the second source/drain terminal of the fourth transistor and being served as the output terminal of the first inverter, the gate terminal of the fifth transistor being served as the input terminal of the first inverter, the gate terminal of the fifth transistor being electrically coupled to the second source/drain terminal of the first transistor, and the second source/drain terminal of the fifth transistor being electrically coupled to the second potential.

6. The electrophoretic display apparatus according to claim 2, wherein the second inverter comprises:

a third transistor having a first source/drain terminal, a second source/drain terminal and a gate terminal, the gate terminal and the first soruce/drain terminal of the third transistor being electrically coupled to the first potential;

a fourth transistor having a first source/drain terminal, a second source/drain terminal and a gate terminal, the first source/drain terminal of the fourth transistor being electrically coupled to the first potential, and the gate terminal of the fourth transistor being electrically coupled to the second source/drain terminal of the third transistor;

a third capacitor electrically coupled between the gate terminal of the fourth transistor and the second source/drain terminal of the fourth transistor; and a fifth transistor having a first source/drain terminal, a second source/drain terminal and a gate terminal, the first source/drain terminal of the fifth transistor being electrically coupled to the second source/drain terminal of the fourth transistor and being served as the output terminal of the second inverter, the gate terminal of the fifth transistor being served as the input terminal of the second inverter, the gate terminal of the fifth transistor being electrically coupled to the second source/drain terminal of the second transistor, and the second source/drain terminal of the fifth transistor being electrically coupled to the second potential.

7. The electrophoretic display apparatus according to claim 1, wherein the first data-latching circuit further comprises a third transistor having a first source/drain terminal, a second source/drain terminal and a gate terminal, the first source/drain terminal and the second source/drain terminal of the third transistor are both electrically coupled to the second source/drain terminal of the first transistor, and the gate terminal of the third transistor is configured for receiving an inverted signal of the data shift-register output pulse.

8. The electrophoretic display apparatus according to claim 1, wherein the first data-latching circuit further comprises a third inverter having an input terminal and an output terminal, and the third inverter is electrically coupled between the second source/drain terminal of the first transistor and the input terminal of the first inverter.

9. The electrophretic display apparatus according to claim 8, wherein the second data-latching circuit further comprises a fourth inverter having an input terminal and an output terminal, the fourth inverter is electrically coupled between the second source/drain terminal of the second transistor and the input terminal of the second inverter.

10. The electrophoretic display apparatus according to claim 1, wherein the second data-latching circuit further comprises a third transistor having a first source/drain terminal, a second source/drain terminal and a gate terminal, the first source/drain terminal and the second source/drain terminal of the third transistor are both electrically coupled to the second source/drain terminal of the second transistor, and the gate terminal of the third transistor is configured for receiving an inverted signal of the latching-enable pulse.

11. The electrophoretic display apparatus of claim 1, wherein the plurality of charged particles comprise black particles and white particles.

12. The electrophoretic display apparatus of claim 1, wherein the plurality of charged particles are with multiple colors.

13. An image-updating method for an electrophoretic display apparatus, the electrophoretic display apparatus comprising a display panel and a source driver, the display panel comprising a plurality of pixels and a plurality of source lines, each of the pixels being electrically coupled to a corresponding one of the source lines, each of the pixels comprising a pixel electrode and a capacitor, the capacitor comprising a plurality of charged particles, the source driver being electrically coupled to the source lines, the source driver comprising a first data-latching circuit and a second data-latching circuit, the first data-latching circuit comprising a first transistor, a first capacitor and a first inverter, the first transistor having a first source/drain terminal, a second source/drain terminal and a gate terminal, the first source/drain terminal of the first transistor being configured for receiving image data, the gate terminal of the first transistor being configured for receiving a data shift-register output pulse, the first capacitor being electrically coupled between the second source/drain terminal of the first transistor and a reference voltage, the first inverter having an input terminal and an output terminal, the input terminal of the first inverter being electrically coupled to the second source/drain terminal of the first transistor, the second data-latching circuit comprising a second transistor, a second capacitor and a second inverter, the second transistor having a first source/drain terminal, a second source/drain terminal and a gate terminal, the first source/drain terminal of the second transistor being electrically coupled to the output terminal of the first inverter, the gate terminal of the second transistor being configured for receiving a latching-enable pulse, the second capacitor being electrically coupled between the second source/drain terminal of the second transistor and the reference voltage, the second inverter having an input terminal and an output terminal, the input terminal of the second inverter being electrically coupled to the second source/drain terminal of the second transistor, the output terminal of the second inverter being electrically coupled to one of the source lines, and the image-updating method comprising:

providing an alternating current (AC) common voltage so that the particles being driven by the electrical field caused by the common electrode and the pixel electrode;

making the AC common voltage present a first potential, and making a voltage of the output terminal of the second inverter present a second potential, so as to erase a previous image; and making the AC common voltage present the second potential, and making the voltage of the output terminal of the second inverter drive a corresponding one of the pixels in three stages, wherein the voltage of the output terminal of the second inverter presents the first potential in a first stage, the voltage of the output terminal of the second inverter presents the second potential in a second stage, and the voltage of the output terminal of the second inverter presents the first potential in a third stage;

wherein the display panel further comprises a plurality of gate lines, each of the pixels is electrically coupled to a corresponding one of the gate lines, the electrophoretic display apparatus further comprises a gate driver electrically coupled to the gate lines for respectively outputting a plurality of gate pulses to the gate lines in sequence, an enabling period of the latching-enable pulse is during an enabling period of a corresponding one of the gate pulses outputted from the gate driver, and an enabling period of the data shift-register output pulse is preceding the enabling period of the corresponding one of the gate pulses outputted from the gate driver.

14. The image-updating method according to claim 13, wherein the second data-latching circuit further comprises a third transistor having a first source/drain terminal, a second source/drain terminal and a gate terminal, the first source/drain terminal of the third transistor is electrically coupled to the second potential, the gate terminal of the third transistor is configured for receiving an inverted signal of the latching-enable pulse, and the second source/drain terminal of the third transistor is electrically coupled to the second source/drain terminal of the second transistor.

15. The image-updating method according to claim 14, wherein the second data-latching circuit further comprises a fourth transistor having a first source/drain terminal, a second source/drain terminal and a gate terminal, the first source/drain terminal of the fourth transistor is electrically coupled to the second source/drain terminal of the third transistor, the gate terminal of the fourth transistor is electrically coupled to the output terminal of the second inverter, and the second source/drain terminal of the fourth transistor is electrically coupled to the second source/drain terminal of the second transistor.

16. The image-updating method according to claim 13, wherein the first inverter comprises:

a third transistor having a first source/drain terminal, a second source/drain terminal and a gate terminal, the gate terminal and the first source/drain terminal of the third transistor being electrically coupled to the first potential;

a fourth transistor having a first source/drain terminal, a second source/drain terminal and a gate terminal, the first source/drain terminal of the fourth transistor being electrically coupled to the first potential, and the gate terminal of the fourth transistor being electrically coupled to the second source/drain terminal of the third transistor;

a third capacitor electrically coupled between the gate terminal of the fourth transistor and the second source/drain terminal of the fourth transistor; and a fifth transistor having a first source/drain terminal, a second source/drain terminal and a gate terminal, the first source/drain terminal of the fifth transistor being electrically coupled to the second source/drain terminal of the fourth transistor and being served as the output terminal of the first inverter, the gate terminal of the fifth transistor being served as the input terminal of the first inverter, the gate terminal of the fifth transistor being electrically coupled to the second source/drain terminal of the first transistor, and the second source/drain terminal of the fifth transistor being electrically coupled to the second potential.

17. The image-updating method according to claim 13, wherein the second inverter comprises:

a third transistor having a first source/drain terminal, a second source/drain terminal and a gate terminal, the gate terminal and the first soruce/drain terminal of the third transistor being electrically coupled to the first potential;

a fourth transistor having a first source/drain terminal, a second source/drain terminal and a gate terminal, the first source/drain terminal of the fourth transistor being electrically coupled to the first potential, and the gate terminal of the fourth transistor being electrically coupled to the second source/drain terminal of the third transistor;

a third capacitor electrically coupled between the gate terminal of the fourth transistor and the second source/drain terminal of the fourth transistor; and a fifth transistor having a first source/drain terminal, a second source/drain terminal and a gate terminal, the first source/drain terminal of the fifth transistor being electrically coupled to the second source/drain terminal of the fourth transistor and being served as the output terminal of the second inverter, the gate terminal of the fifth transistor being served as the input terminal of the second inverter, the gate terminal of the fifth transistor being electrically coupled to the second source/drain terminal of the second transistor, and the second source/drain terminal of the fifth transistor being electrically coupled to the second potential.

18. The image-updating method according to claim 13, wherein the first data-latching circuit further comprises a third transistor having a first source/drain terminal, a second source/drain terminal and a gate terminal, the first source/drain terminal and the second source/drain terminal of the third transistor are both electrically coupled to the second source/drain terminal of the first transistor, and the gate terminal of the third transistor is configured for receiving an inverted signal of the data shift-register output pulse.

* * * * *